US007549772B2

(12) United States Patent
Wang

(10) Patent No.: US 7,549,772 B2
(45) Date of Patent: Jun. 23, 2009

(54) LED LAMP CONDUCTING STRUCTURE WITH PLATE-TYPE HEAT PIPE

(75) Inventor: Pei-Choa Wang, Gueishan Township, Taoyuan County (TW)

(73) Assignee: Pyroswift Holding Co., Limited, Wanchai (HK)

( * ) Notice: Subject to any disclaimer, the term of this patent is extended or adjusted under 35 U.S.C. 154(b) by 531 days.

(21) Appl. No.: 11/393,817

(22) Filed: Mar. 31, 2006

(65) Prior Publication Data

US 2007/0236935 A1 Oct. 11, 2007

(51) Int. Cl.
*F21V 29/00* (2006.01)

(52) U.S. Cl. ..... 362/294; 362/249.02; 362/373

(58) Field of Classification Search ..... 362/294, 362/373, 249, 800, 249.02
See application file for complete search history.

(56) References Cited

U.S. PATENT DOCUMENTS 6,641,284 B2 * 11/2003 Stopa et al. ..... 362/240
7,293,898 B2 * 11/2007 Kumthampinij et al. .... 362/294
7,314,291 B2 * 1/2008 Tain et al. ..... 362/294
2005/0174780 A1 * 8/2005 Park ..... 362/294
2006/0193139 A1 * 8/2006 Sun et al. ..... 362/373
2007/0041220 A1 * 2/2007 Lynch ..... 362/646
2007/0211470 A1 * 9/2007 Huang ..... 362/294

* cited by examiner

*Primary Examiner*—Stephen F. Husar
*Assistant Examiner*—Peggy A. Neils

(57) ABSTRACT

An LED lamp conducting structure includes plate-type heat pipe of mask shape. A support plate mounted with LEDs is fixed on a plate-type heat pipe and then is placed within a lampshade. The plate-type heat pipe is made of metal with good thermal conductivity and has a plurality of through holes defined on bottom thereof. The support plate includes a plurality of electrode holes corresponding to the through holes. The anode contact and cathode contact of the LED are around the electrode hole. The contacts are exposed out of the support plate such that two screw-shaped electrode pins can be connected to the contacts after passing the electrode holes and the through holes. The electrode pins are locked to the plate-type heat pipe by screw such that the electrode pins have electrical connection with the contacts.

20 Claims, 6 Drawing Sheets

LED LAMP CONDUCTING STRUCTURE WITH PLATE-TYPE HEAT PIPE

BACKGROUND OF THE INVENTION

1. Field of the Invention

The present invention relates to an LED lamp, especially to an LED lamp conducting structure with plate-type heat pipe.

2. Description of Prior Art

Light emitting diode (LED) lamp generally comprises a set of LEDs, electrode pins of LED and a heat radiator. The LED generally comprises a first electrode pin and a second electrode pin for conducting electrical current to the LED. As the power and efficiency of LED are increased, heat dissipation is important issues. For example, heat pipe such as plate-type heat pipe (vapor chamber) is important.

The plate-type heat pipe utilizes the principle of phase change for heat dissipation. The plate-type heat pipe generally comprises a heat-absorbing end and a condensation end. The heat-absorbing end is in contact with a heat source to conduct heat from the heat source to a working fluid to vaporize the working fluid. The vaporized working fluid moves to the condensation end for condensation to fluid there. The working fluid then flows back to the heat-absorbing end for completing a heat circle.

The circulation of working fluid in the heat pipe is achieved by gravity or capillarity effect. In gravity-based circulation, the heat-absorbing end is placed below the condensation end. In capillarity-based circulation, wick structure is formed by accommodation tank, metal mesh or porous material inside a container, whereby working fluid is subjected to massive phase change in a closed container.

FIG. 6 shows a sectional view of a prior art lamp with plate-type heat pipe. The lamp comprises a reflection shell 101, a round supporter 102 at top of the reflection shell 101 and a plurality of LEDs 103 on the supporter 102. The light emitted from the LEDs 103 is reflected and focused by the reflection shell 101 to enhance brightness of the lamp.

The plate-type heat pipe is generally made of metal with high thermal conductivity. The plate-type heat pipe is hollow and comprises wick structure and working fluid therein to absorb heat from LED. However, the wiring of the LED is generally arranged along outer surface of the plate-type heat pipe. The cost is high and short circuit problem is possible.

SUMMARY OF THE INVENTION

Accordingly, the present invention provides an LED lamp conducting structure with plate-type heat pipe. The packaged LED is mounted on a support plate and the support plate is fixed to inner bottom side of a mask-shaped plate-type heat pipe by two screw-shaped electrode pins. The electrode pins are connected to an external power supply to form a conduction loop with anode and cathode of the LED.

The support plate comprises anode contact and cathode contact. The anode and cathode of the LED are extended to electrode holes defined on the support plate and exposed there. The electrode pins pass through the electrode holes and the screw-shaped electrode pin is in contact with the contacts e by the head thereof and the support plate is fixed. Therefore the electrode pins have tight contact with the anode contact and the cathode contact.

The support plate and the plate-type heat pipe are made of thermal conducting metal and an insulating cap is provided for the electrode pins and the plate-type heat pipe when the electrode pins pass through the through holes. Two nuts are locked to ends of the electrode pins to lock the electrode pins to the contacts. The nut is also made of metal and an insulating tab is used to isolate the nut with the plate-type heat pipe.

Accordingly, the present invention provides an LED lamp conducting structure with plate-type heat pipe of mask shape. A support plate mounted with LEDs is fixed on a plate-type heat pipe and then is placed within a lampshade. The plate-type heat pipe is made of metal with good thermal conductivity and has a plurality of through holes defined on bottom thereof. The support plate includes a plurality of electrode holes corresponding to the through holes. The anode contact and cathode contact of the LED are around the electrode hole. The contacts are exposed out of the support plate such that two screw-shaped electrode pins can be connected to the contacts after passing the electrode holes and the through holes. The electrode pins are locked to the plate-type heat pipe by screw such that the electrode pins have electrical connection with the contacts.

BRIEF DESCRIPTION OF DRAWING

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

The present invention provides an LED lamp with plate-type heat pipe and detailed description of the present invention will be described with reference to drawings.

Figure 1:
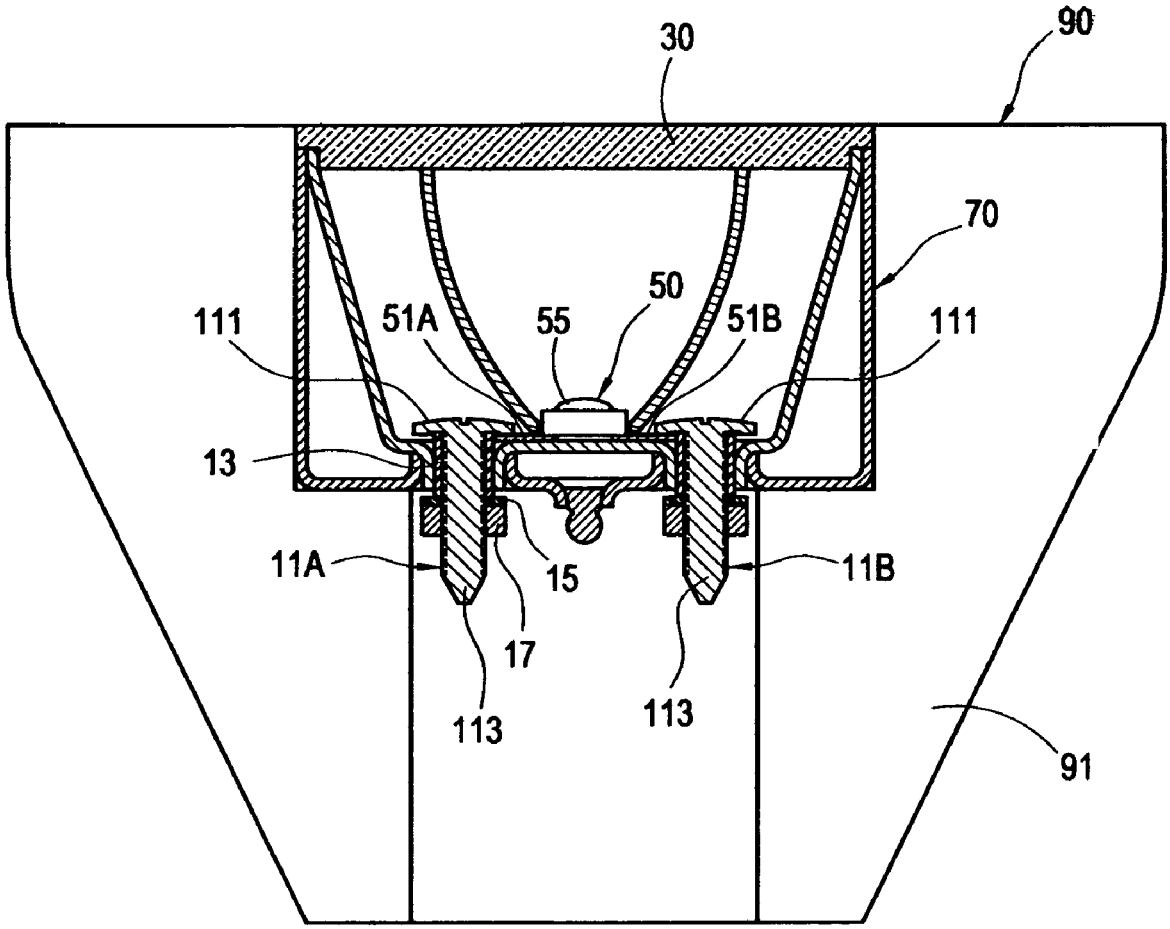
FIG. 1 shows a section view of the present invention.
Figure 2:
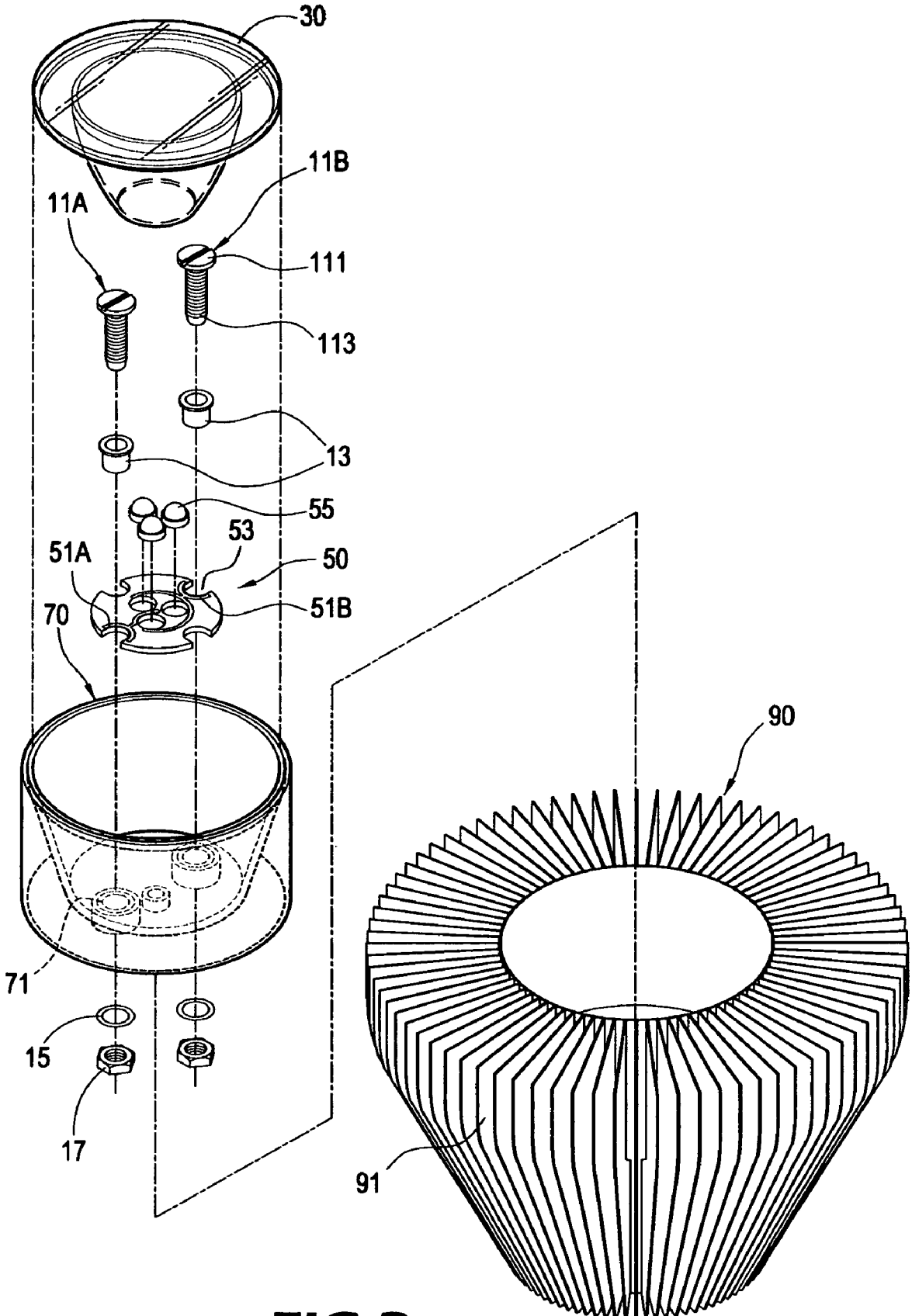
FIG. 2 is an exploded view of the present invention.

The present invention is intended to provide LED lamp with plate-type heat pipe. FIG. 1 shows a section view of the present invention and FIG. 2 shows an exploded view of the present invention. According to a preferred embodiment of the present invention, an LED 55 is arranged on a support plate 50, and a first electrode pin 11A and a second electrode pin 11B are locked to an inner side of a mask-shaped plate-type heat pipe 70. A reflection shell 30 is arranged in front of the LED 55 to focus the light from the LED 55 to intensify the light. Two through holes 71 are defined through the plate-type heat pipe 70 and through which the first electrode pin 11A and the second electrode pin 11B pass, respectively. The plate-type heat pipe 70 is placed within a lampshade 90 and the lampshade 90 comprises a plurality of heat-dissipation plates 91.

Figure 4:
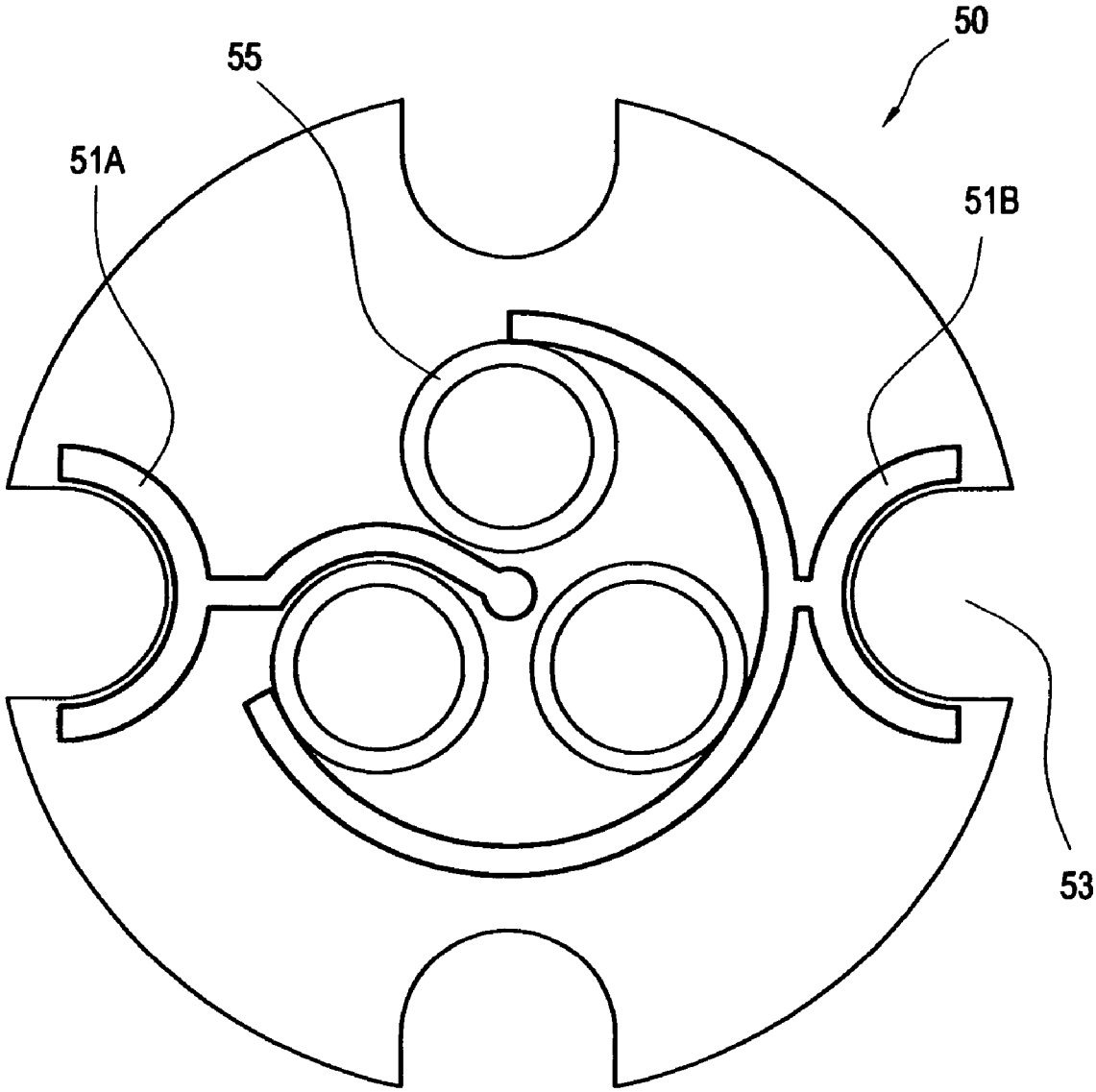
FIG. 4 is a top view of a support plate of the present invention.

FIG. 4 is a top view of the support plate 50. The support plate 50 is a round metal disk and has a plurality of packaged LEDs 55 atop the support plate 50. The anode and cathode of the LED 55 are arranged on edges of the electrode holes 53, where the electrode holes 53 are round holes defined on the support plate 50. Exposed anode contact 51B and cathode 51A are arranged around the electrode holes 53. Because the anode contact 51B and cathode 51A are exposed, the first electrode pin 11A and the second electrode pin 11B are directly in contact with the anode contact 51B and cathode 51A when the first electrode pin 11A and the second electrode pin 11B pass through the electrode holes 53.

Figure 3:
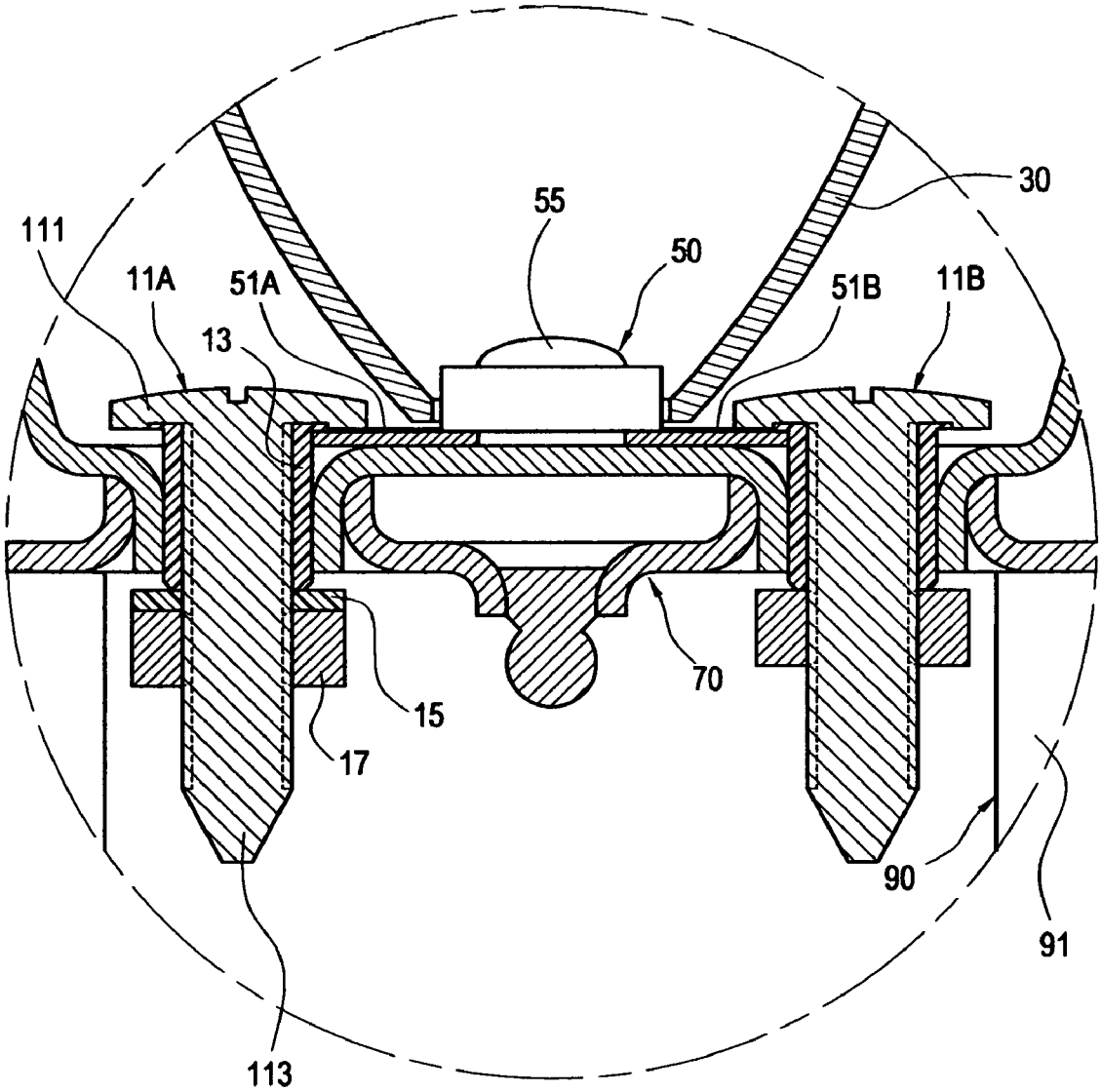
FIG. 3 shows a partially enlarged view of FIG. 1.

FIG. 3 shows a partially enlarged view of FIG. 1. With reference also to FIG. 1, the support plate 50 is arranged within the plate-type heat pipe 70 and the LED 55 is arranged on the support plate 50. The anode contact and the cathode contact of the LED 55 are extended to place near the electrode holes 53 of the support plate 50 through circuit of the support plate 50. Moreover, for the connection of the first electrode pin 11A and the second electrode pin 11B with the anode contact and the cathode contact of the LED 55, the anode contact 51B and cathode 51A are exposed outside the support plate 50.

The plate-type heat pipe 70 comprises two layers of cylinders with a vacuum therein and a working fluid is provided therein. The heat generated by the LED 55 is conveyed outside by the phase change of the working fluid. The heat is dissipated by the lampshade 90 to fast dissipate the heat generated by the LED 55. A shell of the plate-type heat pipe 70 is preferably made of metal with high thermal conductivity such as copper. The first electrode pin 11A and the second electrode pin 11B are good electrical conductor and used to support the support plate 50 outside the plate-type heat pipe 70. Moreover, the first electrode pin 11A and the second electrode pin 11B are connected to a power supply and form a conduction loop with the anode and cathode of the LED 55.

According to a preferred embodiment of the present invention, the support plate 50 is a copper substrate of round disk shape and an insulating layer (not shown) is arranged between the copper substrate and the wiring of the LED 55 to prevent short circuit between the support plate 50 and LED 55. The copper substrate facilitates a heat conduction from the LED 55 to the plate-type heat pipe 70 through the support plate 50. To provide tight surface contact between the support plate 50 and the plate-type heat pipe 70, solder tin is preferably provided therebetween such that heat can be efficiently conducted from the support plate 50 to the plate-type heat pipe 70.

The shell of the plate-type heat pipe 70 is made of copper, which is also a good electrical conductor. Therefore, the first electrode pin 11A and the second electrode pin 11B should be separated from the plate-type heat pipe 70 to prevent short circuit therefrom. Therefore, two insulating caps 13 are provided for the first electrode pin 11A and the second electrode pin 11B when the first electrode pin 11A and the second pin electrode 11B pass through the through holes 71. The first electrode pin 11A and the second electrode pin 11B are fixed by a nut 17. Moreover, an insulating tab 15 is provided between the nut 17 and the plate-type heat pipe 70 to prevent short circuit between the first electrode pin 11A and the second electrode pin 11B and the plate-type heat pipe 70.

With reference to FIGS. 1 to 3, the LED 55 can be electrically connected to external power source to power the LED 55. The anode and cathode of the LED 55 are extended to place near the electrode holes 53. The first electrode pin 11A and the second electrode pin 11B pass through the electrode holes 53 and the through hole 71. The first pin electrode 11A and the second electrode pin 11B are fixed to the anode contact 51B and cathode contact 51A by the nut 17. The first pin 11A and the second pin 11B are separated with the through hole 71 by the insulating cap 13. The heat generated by the LED 55 is conducted to the plate-type heat pipe 70 through the support plate 50 and dissipates to external environment through the lamp shade 90 composed of the heat dissipation plates 91. The electrical connection of the LED 55 will be detailed below.

With reference to FIGS. 2 and 3, the first electrode pin 11A and the second electrode pin 11B are of screw shape and each comprises a connection end 111 and a threaded long rod 113 extended from the lower end of the connection end 111. Therefore, the first electrode pin 11A and the second electrode pin 11B can be fixed by the nut 17; and the first electrode pin 11A and the second electrode pin 11B have tight contact with the electrode 51A and 51B.

Figure 5:
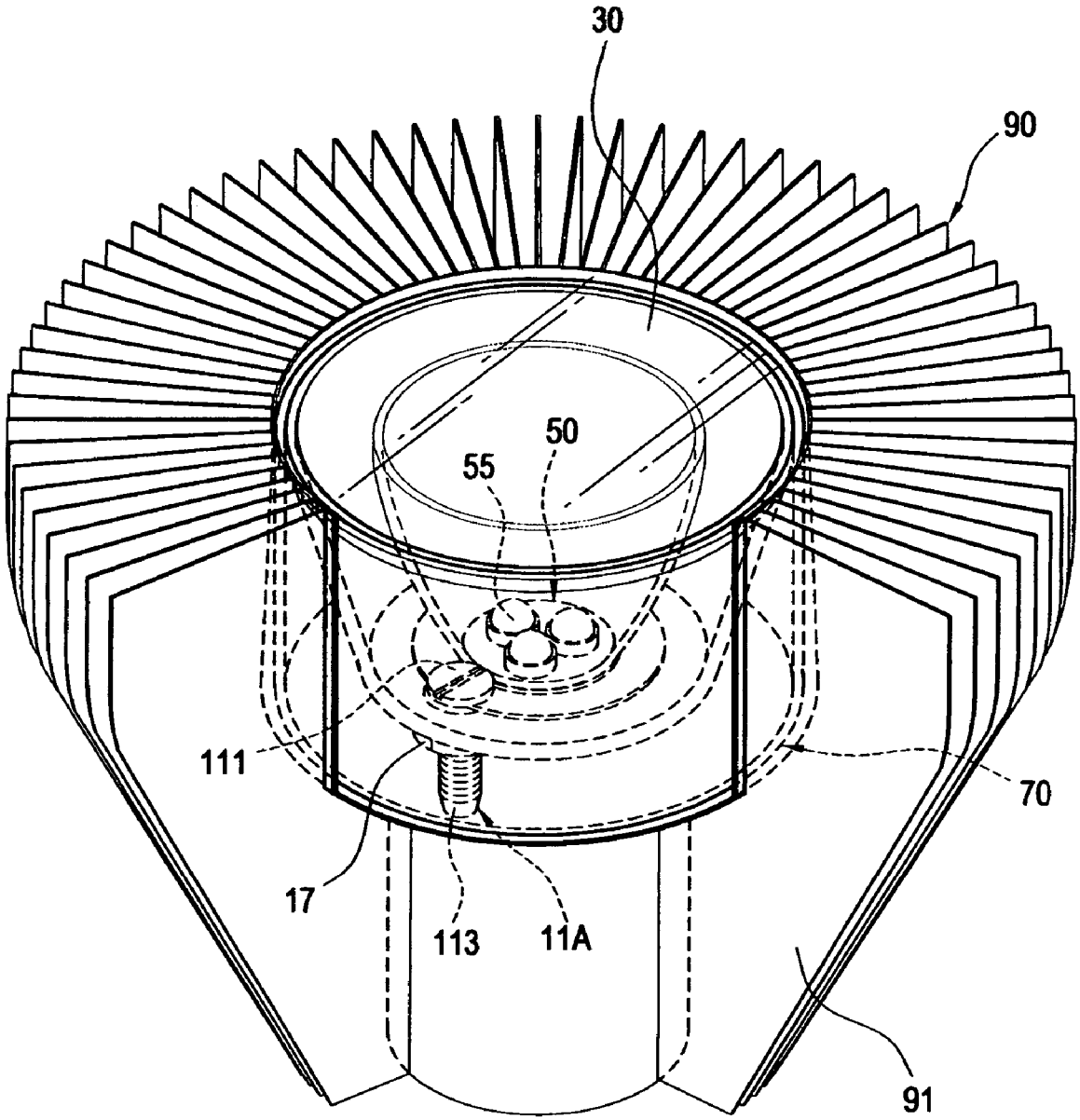
FIG. 5 is a perspective view of the present invention.
Figure 6:
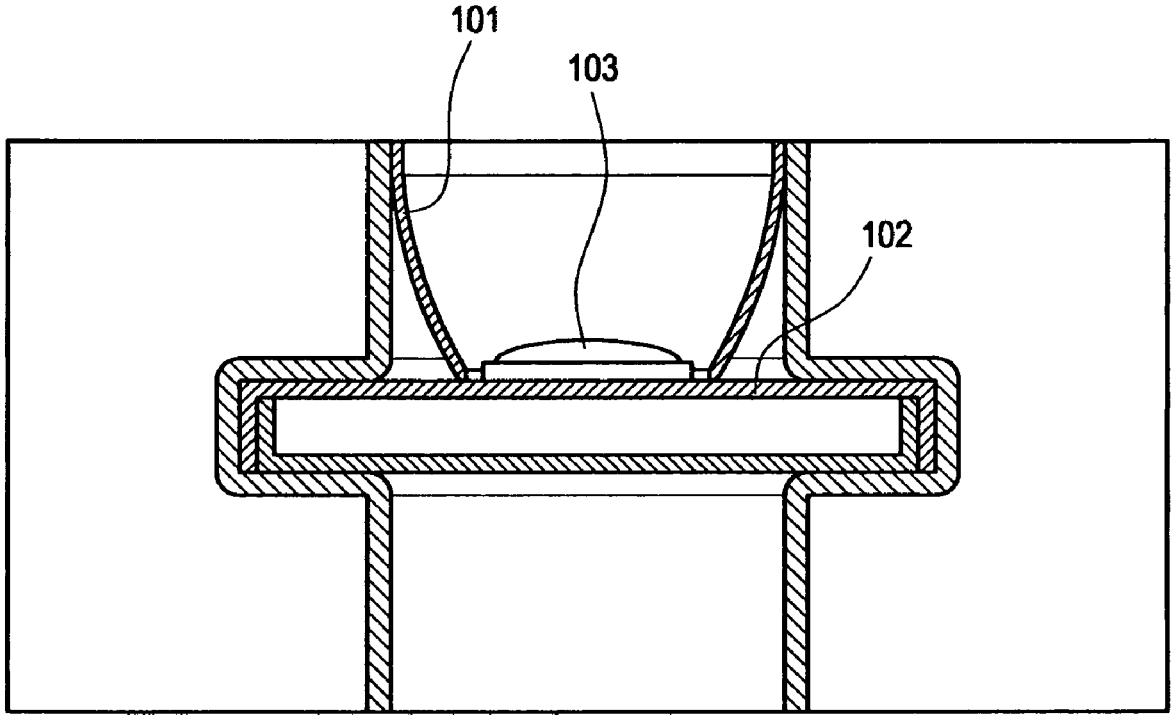
FIG. 6 shows a sectional view of a prior art lamp with plate-type heat pipe.

FIG. 2 shows the exploded view of the present invention and FIG. 5 shows the perspective view of the present invention. As shown in FIG. 2, the support plate 50 according to the present invention comprises a round copper substrate and a plurality of LEDs 55 on the substrate. The support plate 50 comprises two electrode hole 53 defined symmetrically thereon. The anode contact 5B and cathode contact 51A of the LED 55 are around the electrode hole 53. Moreover, the anode contact 51B and cathode contact 51A are extended to the electrode hole 53 for contacting to external power source.

With reference to FIGS. 2 and 5, the support plate 50 is placed in the plate-type heat pipe 70 and the plate-type heat pipe 70 is a round cylinder formed by a planar heat pipe. The support plate 50 is placed on an inner bottom face of the plate-type heat pipe 70. Moreover, two through holes 71 are defined on bottom of the plate-type heat pipe 70 and corresponding to the two electrode hole 53 of the support plate 50. Moreover, to vacuum the plate-type heat pipe 70, a sealing hole is defined on outer bottom face of the plate-type heat pipe 70. The sealing hole is sealed after the plate-type heat pipe 70 is vacuumed.

Because copper is good conductor, the conductive circuit for the LED 55 should be carefully designed to prevent short circuit of the plate-type heat pipe 70, the support plate 50 and the external power source. Moreover, the reflection shell 30 is arranged in front of the LED 55. The support plate 50 is placed on the plate-type heat pipe 70 and is connected through radial lampshade 90 such that the heat generated by the LED 55 can be conducted through the plate-type heat pipe 70 and radiated by the lampshade 90.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. An LED lamp conducting structure with plate-type heat pipe, comprising:

a plate-type heat pipe being a metal mask with two through holes, the plate-type heat pipe comprising a shell with a vacuum therein and a working fluid provided in the shell;

a support plate with a plurality of LEDs thereon and the support plate being arranged on the plate-type heat pipe, the LED having anode contact and cathode contact arranged around the support plate and the through holes;

two electrode pins made of good electrical conductor and passing through the through holes of the plate-type heat pipe and electrode holes of the support plate, the two electrode pins electrically connected to the anode contact and the cathode contact of the support plate.

2. The LED lamp conducting structure as in claim 1, further comprising two insulating caps arranged around the pins and on the through holes of the plate-type heat pipe.

3. The LED lamp conducting structure as in claim 1, wherein two electrode holes are defined on the support plate and corresponding to the through holes of the plate-type heat pipe.

4. The LED lamp conducting structure as in claim 3, wherein the anode contact and cathode contact are arranged around the electrode holes.

5. The LED lamp conducting structure as in claim 1, further comprising a reflection shell arranged in the plate-type heat pipe and in front of the LED.

6. The LED lamp conducting structure as in claim 1, wherein the support plate is of round disk shape.

7. The LED lamp conducting structure as in claim 1, wherein a lampshade is connected to peripheral of the plate-type heat pipe.

8. The LED lamp conducting structure as in claim 7, wherein the lampshade comprises a plurality of heat-dissipation plates.

9. The LED lamp conducting structure as in claim 7, wherein the lampshade is in radial shape.

10. The LED lamp conducting structure as in claim 1, wherein the electrode pins are arranged to a power supply.

11. The LED lamp conducting structure as in claim 1, wherein the plate-type heat pipe is made of metal with good thermal conductivity.

12. The LED lamp conducting structure as in claim 11, wherein the plate-type heat pipe comprises copper metal.

13. The LED lamp conducting structure as in claim 1, wherein the electrode pin comprises a long rod extended downward from a connection end.

14. The LED lamp conducting structure as in claim 13, wherein the long rod is a threaded long rod.

15. The LED lamp conducting structure as in claim 14, wherein the electrode pin is screwed to a nut on an end thereof.

16. The LED lamp conducting structure as in claim 15, wherein two insulating tabs are arranged between the nut and the plate-type heat pipe.

17. The LED lamp conducting structure as in claim 1, wherein the anode contact and cathode contact are exposed and around the through hole.

18. The LED lamp conducting structure as in claim 17, wherein the anode contact and cathode contact are connected to the connection end of the electrode pins.

19. The LED lamp conducting structure as in claim 1, wherein the support plate comprises copper metal.

20. The LED lamp conducting structure as in claim 1, wherein the shell has a barrel shape and comprises two layers of cylinders with the vacuum therein.

* * * * *